US005098127A

United States Patent [19]

Williamson et al.

[11] Patent Number: 5,098,127

[45] Date of Patent: Mar. 24, 1992

[54] MAGAZINE ADVERTISING INSERT

[75] Inventors: Jesse S. Williamson, Dallas; Frederick I. Reinbold, Jr., Grand Prairie, both of Tex.

[73] Assignee: Williamson Printing Corporation, Dallas, Tex.

[21] Appl. No.: 418,111

[22] Filed: Oct. 6, 1989

[51] Int. Cl.[5] ..... B42D 1/00

[52] U.S. Cl. ..... 281/15.1; 281/21.1; 281/35; 281/36; 281/38

[58] Field of Search ..... 281/15.1, 21.1, 35, 281/36, 37, 38

[56] References Cited

U.S. PATENT DOCUMENTS

| | | | |
|---|---|---|---|
| 4,492,306 | 1/1985 | Cooper et al. | 281/15.1 X |
| 4,596,407 | 6/1986 | Suska | 281/15.1 |
| 4,789,187 | 12/1988 | Corlew et al. | 281/15.1 |

FOREIGN PATENT DOCUMENTS

| | | | |
|---|---|---|---|
| 154330 | 11/1902 | Fed. Rep. of Germany | 281/15.1 |
| 8436 | of 1911 | United Kingdom | 281/15.1 |

OTHER PUBLICATIONS

Dec. 1988, Money Magazine, pp. 110-111.

*Primary Examiner*—Paul A. Bell

*Attorney, Agent, or Firm*—Hubbard, Thurman, Tucker & Harris

[57] ABSTRACT

An advertising insert is secured, page-like, within a magazine and comprises a folded-over rectangular jacket sheet having adhesively intersecured edge portions positioned opposite its fold line and adhesively secured to an edge flap of an anchor sheet bound into the magazine. The top sheet portion of the folded jacket has formed therein a perforation line positioned closely adjacent and extending parallel to the two intersecured jacket edges which, in turn, extend parallel to the central magazine fold axis. An advertising booklet is removably secured and concealed within the folded jacket, and has a fold axis extending transversely to the magazine fold axis. The concealed advertising booklet may be exposed for removal by tearing the jacket along its perforation line and outwardly folding its top sheet portion. Because the booklet-enclosing folded jacket is open along two of its four side edges it is not classified, under U.S. postal regulations, as an "envelope" or a "pocket". Accordingly, the advertising insert of the present invention is not classified as a "supplement" requiring the addition of a third class "upcharge" to the mailing cost of the magazine. Instead, despite the presence of the enclosing jacket, it is more advantageously classified as a "novelty page" which, like the magazine itself, is entitled to be mailed at the second class postage rate.

13 Claims, 2 Drawing Sheets

MAGAZINE ADVERTISING INSERT

BACKGROUND OF THE INVENTION

The present invention relates generally to advertising inserts for magazines or the like and, in a preferred embodiment thereof, more particularly provides a magazine insert that includes an advertising booklet concealed and removably secured within a folded jacket sheet which is supported page-like within the magazine and may be torn open along a perforation line thereof to reveal and permit removal therefrom of the booklet. Due to the configuration of the folded jacket, the insert is classified, like the magazine itself, as being mailable at the second class postage rate, and does incur the third class "upcharge" normally imposed on magazine advertising inserts disposed within bound-in pockets or envelopes.

It is now quite common practice to insert removable advertising supplements, such as booklets or pamphlets, into magazines in addition to printing advertising on various of their bound together sheets. These advertising booklets are often directly bound into the magazines, using their central page staples, so that the booklets are immediately exposed to the reader's view when he turns the page behind which the booklet is positioned.

However, as a result of advertising ingenuity, another approach to presenting these insert booklets to the magazine reader has been employed—namely, to conceal the booklets within pockets or envelopes secured page-like within the magazines. The theory behind this initial concealment of the actual advertising material is twofold. First, it sets the material apart from other, immediately visible, advertising material inserted into the magazine or simply printed on its pages. Second, the initial concealment of the advertising material at least to some extent piques the reader's curiosity and tends to cause him to open the envelope or pocket, remove the advertising material therefrom, and actually read the material instead of bypassing it to reach the non-advertising portions of the magazine.

Offsetting its overall desirability, however, is the fact that this advertising ploy has heretofore carried with it an unavoidable cost burden—an increased mailing charge attributable to the envelope or pocket structure used to initially conceal the actual advertising material. This conventional concealing structure has typically caused the overall insert to be classified as third class material which, due to its inclusion with the magazine (mailable at the second class postage rate), triggers a third class "upcharge" that is added to the normal second class rate of the magazine. This mailing rate upcharge is typically borne by the advertiser(s) creating it.

It can be seen from the foregoing that it would be highly desirable, from the advertiser's overall cost standpoint, to provide an advertising insert of the general type described above which does not trigger the aforementioned imposition of the third class upcharge. It is accordingly an object of the present invention to provide such an insert.

SUMMARY OF THE INVENTION

In carrying out principles of the present invention, in accordance with a preferred embodiment thereof, a magazine advertising insert is provided in which an advertising booklet is concealed and removably supported within a folded jacket carried page-like within the magazine on a folded edge portion of an anchor sheet bound into the magazine.

The concealing jacket is formed from an elongated rectangular sheet of paper which is longitudinally folded at its center to bring opposite end edge portions thereof together, the folded jacket thereby having an upper sheet portion which overlies a lower sheet portion. The facing end edge portions of the folded jacket sheet are adhesively bonded to one another along an attachment line adjacent their outer edges, and the lower sheet end edge portion is adhesively secured along and parallel to the length of the folded edge portion of the anchor sheet. With the jacket attached to the magazine in this manner, its central fold line is spaced from and extends parallel to the fold axis of the magazine. A tear-away perforation line is formed completely across the upper jacket sheet portion and extends parallel to the jacket end edge adhesive attachment line slightly inwardly thereof.

The advertising booklet is removably secured to the inner side surface of the bottom jacket sheet portion with a suitable peel-off adhesive and, until the jacket is opened, is completely covered by the upper jacket sheet portion. In a preferred embodiment thereof, the booklet is of an elongated rectangular shape and longitudinally extends parallel to the magazine fold axis from adjacent one of the open side edges of the jacket to adjacent its opposite open side edge, the fold axis of the booklet extending transversely to the magazine fold axis.

To gain access to the previously concealed advertising booklet, the magazine reader simply tears the top jacket sheet portion along its perforation line and outwardly folds the now freed major portion of the top jacket sheet portion. The exposed booklet may then be pulled apart from the jacket, opened and perused by the reader. The elongated page configuration of the booklet, in its preferred embodiment, lends itself to displaying, on facing sheets thereof, elongated advertised articles such as automobiles or the like.

In an alternate embodiment of the invention, the closed end of the advertising booklet is received in a folded support sheet and stapled thereto along a perforated fold line thereof. An end portion of the folded support sheet underlies the booklet and is adhesively bonded to the inner side surface of the bottom jacket sheet portion. To remove the booklet (after the top jacket sheet is torn along its perforation line) it is simply pulled apart from the folded support sheet, causing the booklet staples to tear through the perforated fold line of the support sheet which remains secured to the inner side surface of the bottom jacket sheet portion.

Importantly, since the folded jacket, in which the advertising booklet is initially hidden from reader view, is open along two side edges thereof it is not classified, under current U.S. postal regulations, as either an "envelope" or a "pocket". Accordingly, the overall advertising insert of the present invention is classified as a magazine "novelty page" which is entitled to the same second class mailing rate as the magazine itself. It is not classified as a "supplement" subject to the aforementioned third class upcharge.

DETAILED DESCRIPTION

Figure 1:
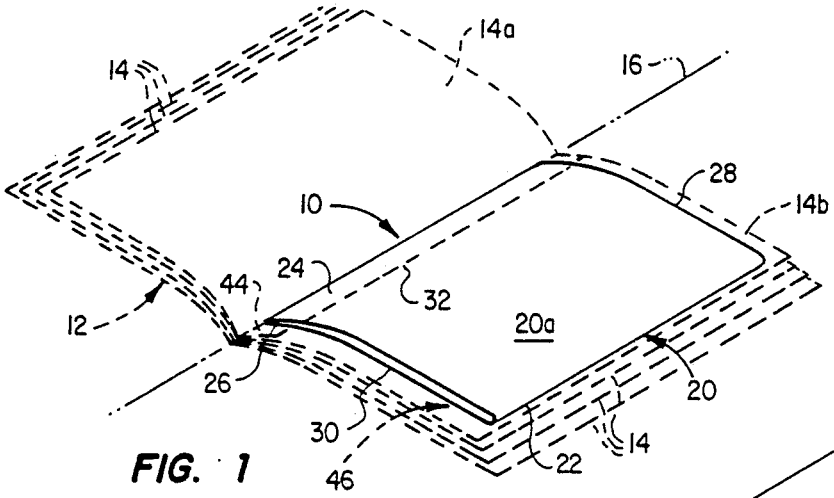
FIG. 1 is a perspective view of a representative, opened magazine (shown in phantom) having attached therein an advertising insert which embodies principles of the present invention.
Figure 4:
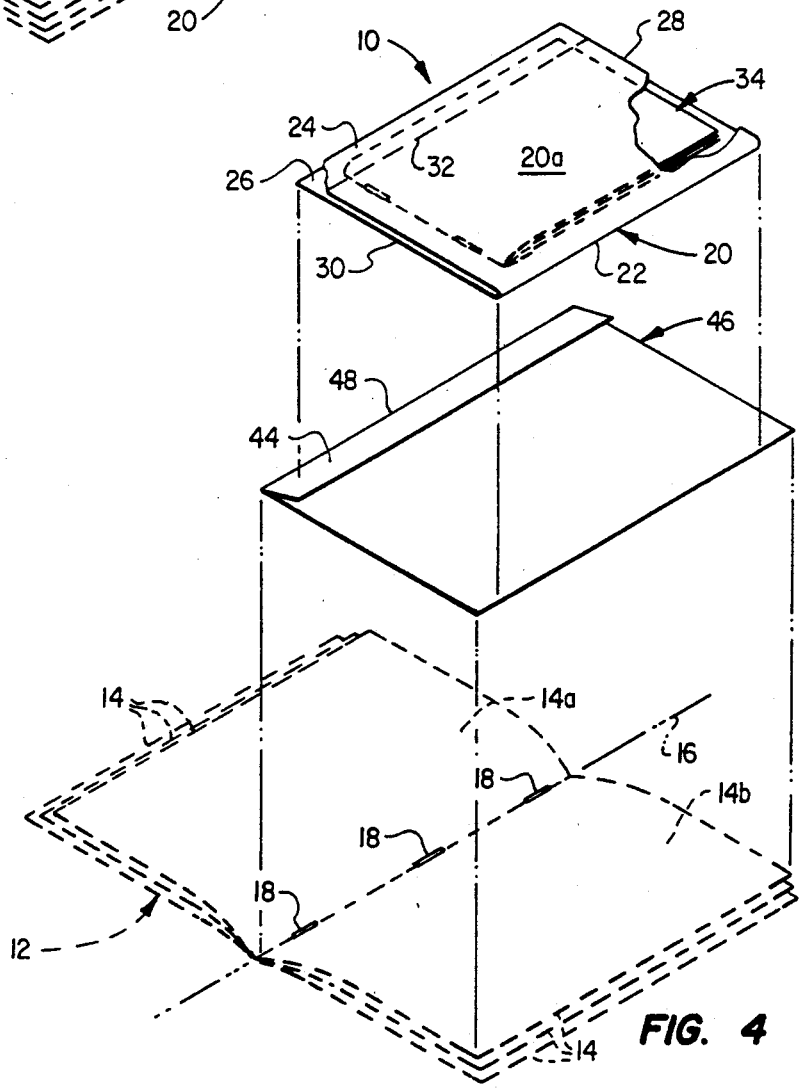
FIG. 4 is an exploded, partially cut away perspective view of the insert, the phantomed magazine, and an anchor sheet which is bound into the magazine and used to support the folded insert jacket therein.

Referring initially to FIGS. 1 and 4, the present invention provides an advertising insert 10 which is securable, page-like, within a magazine 12 having a series of pages 14, including pages $14_a$ and $14_b$ between which the insert is positioned, which are centrally intersecured along a fold axis 16 as by staples 18 (FIG. 4).

As illustrated in FIGS. 1–4, the insert 10 includes an elongated rectangular jacket sheet 20 which is centrally folded lengthwise about a fold line 22 to bring opposite top and bottom free end edge portions 24 and 26 together, the free end edge portions 24 and 26 being adhesively intersecured. In this folded orientation, the jacket sheet 20 has opposed upper and lower side portions $20_a$ and $20_b$, a pair of opposite closed side edge portions extending along the fold line 22 and the intersecured end edge portions 24 and 26, and a pair of opposite open side edge portions 28 and 30 (FIGS. 1 and 4) extending between the two closed side edge portions. For purposes later described, a tearaway perforation line 32 is formed through the jacket sheet upper side portion $20_a$ between the open side edge portions 28 and 30, and extends parallel to the intersecured end edge portions 24 and 26 slightly inwardly thereof.

The insert 10 also includes an advertising booklet 34 having an elongated rectangular configuration and formed from a series of pages 36 centrally intersecured, as by staples 38, along a fold axis 40 positioned at one end of the booklet. The booklet 34 is removably secured to the inner side surface of the jacket sheet side portion $20_b$ by a suitable peel-off adhesive material 42 (FIG. 3) and, as best illustrated in FIGS. 1 and 4, is initially concealed from the magazine reader's view by the top jacket sheet side portion $20_a$ which overlies the booklet. The in-place booklet 34 extends lengthwise within the folded jacket sheet 20 from adjacent its open side edge portion 28 (FIG. 4) to adjacent its open side edge portion 30, with the booklet fold axis 40 (FIG. 2) extending perpendicularly to the magazine fold axis 16.

To secure the insert 10 page-like within the magazine 12, the bottom jacket sheet end edge portion 26 is adhesively secured to the folded-over edge portion 44 of an anchor sheet 46 (FIG. 4). The anchor sheet 46 is, in turn, bound into the magazine 12, along the left side fold line 48 of the anchor sheet, by the magazine staples 18.

As illustrated in FIG. 1, with the magazine opened to pages $14_a$ and $14_b$, the advertising booklet 34 is initially concealed, within the folded jacket sheet 20, from the reader's view, thereby piquing his interest as to what is contained within the folded jacket. By simply tearing the jacket sheet upper side portion $20_a$ along the perforation line 32, and folding the freed portion of the portion $20_a$ rightwardly, as indicated by the arrow 50 in FIG. 2, the booklet 34 is revealed. The now exposed booklet 34 may be removed from the jacket sheet side portion $20_b$, as indicated by the arrow 52 in FIG. 3, and opened to reveal its advertising contents. The elongated configuration of the booklet 34, in its opened condition, renders it quite suitable for illustrating elongated objects such as the automobile 54 shown in FIG. 3.

Importantly, even though the advertising booklet 34 is initially concealed by the folded jacket sheet 20, the overall insert 10 is classified as a "novelty page" which is entitled to the second class mailing rate of the magazine itself. Due to the fact that the folded jacket sheet 20 has two open sides (defined by the open side edge portions 28 and 30), the insert is not classified as a "supplement" which would otherwise add a third class "upcharge" to the cost of mailing the magazine. Accordingly, the overall magazine/insert package is entitled to be mailed at the magazine's normal second class postage rate.

The advertising insert 10 just described may be very easily and rapidly formed, and inserted into the magazine using the anchor sheet 46. The anchor sheet 46, in turn, may be easily formed from a sheet of paper stock just slightly longer than the widths of the magazine pages 14.

Figure 6:
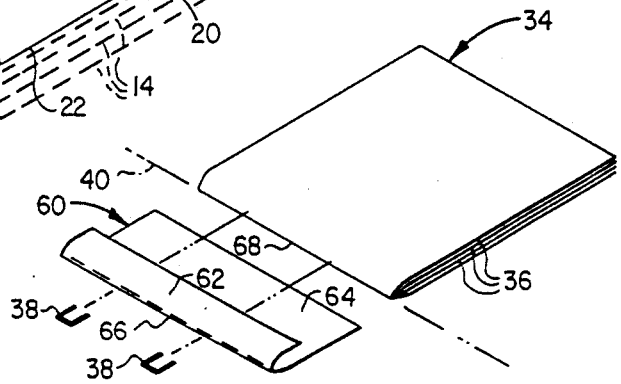
FIG. 6 is an exploded perspective view of the advertising booklet and a folded support sheet used to removably secure the booklet within the jacket portion of the insert.
Figure 2:
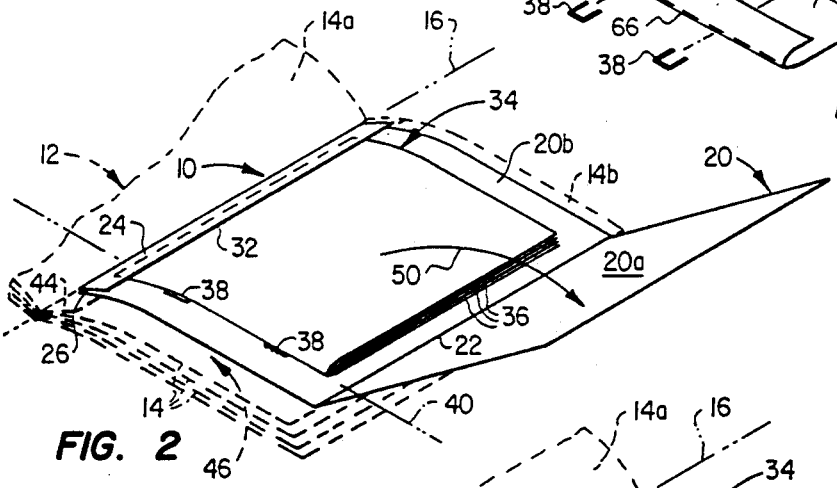
FIG. 2 is a partial perspective view of the magazine illustrating the opening of a folded jacket portion of the insert to reveal an advertising booklet removably secured therein.
Figure 5:
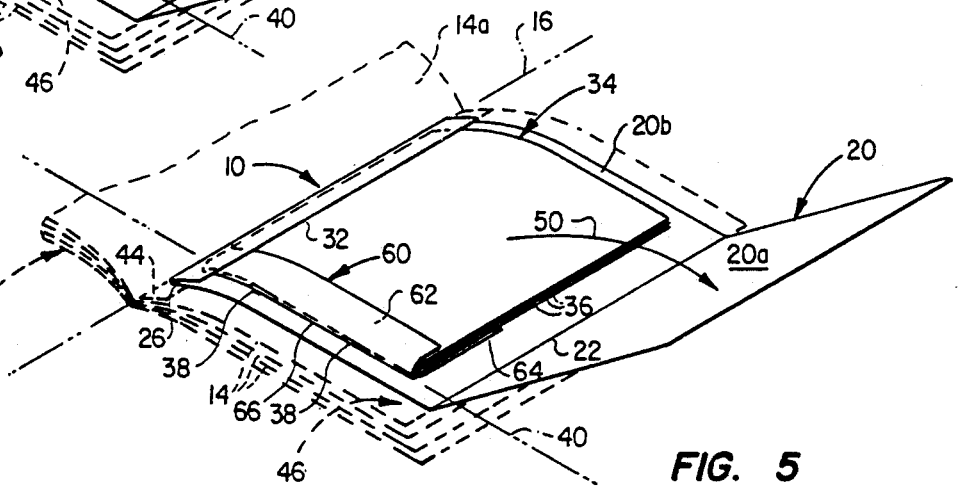
FIG. 5 is a view similar to that in FIG. 2, but illustrating an alternate method of securing the advertising booklet to the folded jacket portion of the insert.
Figure 3:
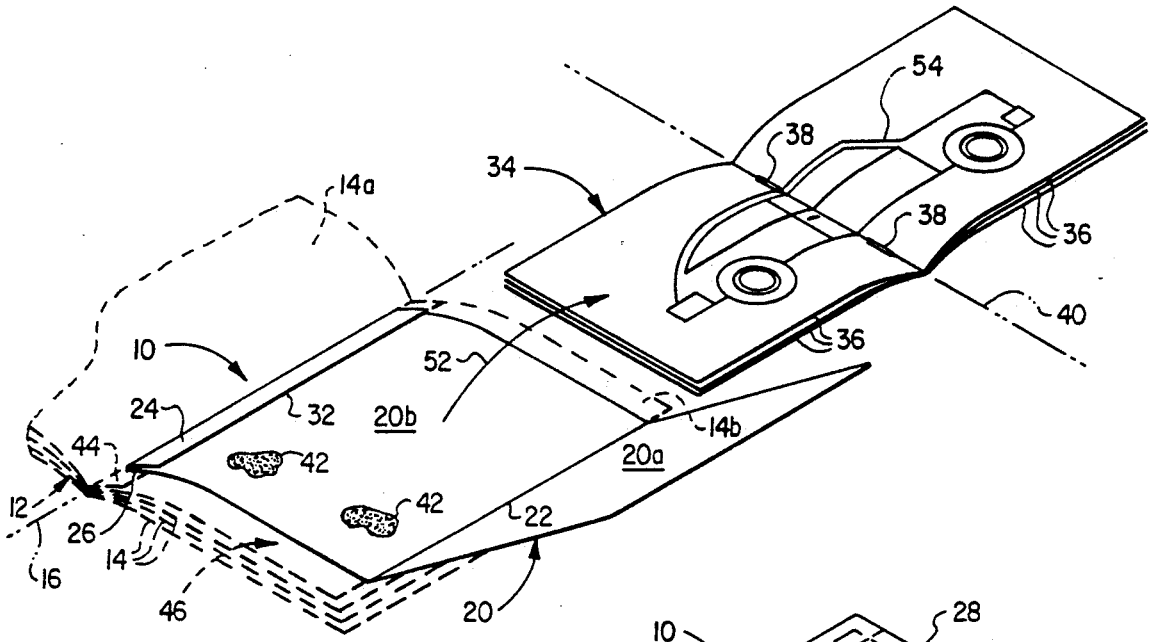
FIG. 3 is a view similar to that shown in FIG. 2, but with the advertising booklet removed from its folded jacket and opened.

An alternate method of removably securing the advertising booklet 34 to the inner side surface of the jacket sheet side portion $20_b$ is illustrated in FIGS. 5 and 6 and entails the use of a folded support sheet 60 having upper and lower end portions 62 and 64 joined along a perforated fold line 66. The closed end 68 of the booklet 34 is received between the end portions 62, 64 of the support sheet 60, and secured thereto by the staples 38 which extend through the perforated fold line 66 into the closed end 68 of the booklet. The bottom support sheet portion 64 is adhesively bonded to the jacket sheet side portion $20_b$. To remove the booklet 34, it is simply pulled apart from the support sheet 60, the staples 38 tearing through the perforated fold line 66 and leaving the support sheet 60 secured to the jacket sheet side portion $20_b$.

The foregoing detailed description is to be clearly understood as being given by way of illustration and example only, the spirit and scope of present invention being limited solely by the appended claims.

What is claimed is:

1. Insert apparatus securable page-like within a magazine or other multipage document having a series of pages centrally interconnected generally along a fold axis of the magazine, said insert apparatus comprising:

a jacket structure including:

a flexible jacket sheet member centrally folded along a fold line to bring opposite free edge portions of the folded jacket sheet member together, means for intersecuring said opposite free edge portions, whereby the folded jacket sheet member has first and second facing side portions, a pair of opposite closed side edge portions extending along said fold line and the intersecured free edge portions of the folded jacket sheet member, and a pair of opposite open side edge portions extending between said fold line and the intersecured free edge portions of the folded jacket sheet member, and a tear-away perforation line formed along one of said first and second facing side portions, extending between said opposite open side edge portions, and being inwardly adjacent and generally parallel to the intersecured free edge portions of the folded jacket sheet member; and a booklet or multipage advertising material concealed and removably secured within the interior of the folded jacket sheet member, said booklet, in its closed orientation, having an elongated configuration and extending lengthwise from adjacent one of said pair of opposite open side edge portions to adjacent the other of said pair of opposite open side edge portions, said booklet having a page fold axis extending transversely to its length and transversely to said fold line, said booklet being exposable to view, and removable from within the fold jacket sheet member by tearing said one of said first and second facing side portions of the folded jacket sheet member along said perforation line and outwardly bending a freed portion of said one of said first and second facing side portions.

2. The insert apparatus of claim 1 wherein:

the width of said booklet extends from adjacent the intersecured free edge portions of the folded jacket sheet member to adjacent said fold line thereof.

3. The insert apparatus of claim 1 wherein:

said booklet or multipage advertising material is removably bonded to a side portion of said folded jacket sheet member with a peel-off adhesive material.

4. Insert apparatus securable page-like within a magazine or other bound multi-page document having a series of pages centrally interconnected generally along a fold axis of the magazine, said insert apparatus comprising:

a jacket structure including:

a flexible jacket sheet member centrally folded along a fold line to bring opposite free edge portions of the folded jacket sheet member together, means for intersecuring said opposite free edge portions, whereby the folded jacket sheet member has first and second facing side portions, a pair of opposite closed side edge portions extending along said fold line in the intersecured free edge portions of the folded jacket sheet member, and a pair of open side edge portions extending between said fold line and the intersecured free edge portions of the folded jacket sheet member, and a tear-away perforation line formed along one of said first and second facing side portions, extending between said opposite open side edge portions, and being inwardly adjacent and generally parallel to the intersecured free edge portions of the folded jacket sheet member; and a booklet or multipage advertising material concealed and removably secured within the interior of the folded jacket sheet member, said booklet, in its closed orientation, having an elongated configuration and extending lengthwise from adjacent one of said pair of opposite open side edge portions to adjacent the other of said pair of opposite open side edge portions, said booklet having a page fold axis extending transversely to its length and transversely to said fold line, said booklet or multipage advertising material being exposable to view, and removable from within the folded jacket sheet member, by tearing said one of said first and second facing side portions of the folded jacket sheet member along said perforation line and outwardly bending a freed portion of said one of said first and second facing side portions, said booklet or multipage advertising material having a closed end portion received within a folded support sheet having a perforated fold line and an end portion which underlies said closed end portion of said booklet or multipage advertising material and is adhesively secured to a side portion of said folded jacket sheet member, said booklet or multipage advertising material being removably secured to said folded support sheet by at least one staple member extending through said perforated fold line into said closed end portion of said booklet or multipage advertising material.

5. The insert apparatus of claim 4 further comprising:

means for securing said jacket structure in a page-like orientation with the magazine.

6. The insert apparatus of claim 5 wherein:

said means for securing is operative to attach the intersecured free edge portions of the folded jacket sheet member within the magazine closely adjacent and generally parallel to the fold axis of the magazine.

7. The insert apparatus of claim 4 wherein:

the width of said booklet extends from adjacent the intersecured free edge portions of the folded jacket sheet member to adjacent said fold line thereof.

8. A method of fabricating an advertising insert securable page-like within a magazine or other multipage document, said method comprising the steps of:

providing an elongated rectangular jacket sheet member having first and second longitudinal halves and first and second outer and end edge portions respectively associated with said first and second longitudinal halves;

removably securing an advertising booklet or multipage advertising material to said first longitudinal half of said jacket sheet member inwardly of said first outer end edge portion;

forming a transverse perforation line across said second longitudinal half of said jacket sheet member parallel to and closely adjacent said second outer end edge portion;

folding said second longitudinal half of said jacket sheet member over said advertising booklet; and intersecuring said first and second outer end edge portions of the folded jacket sheet member to conceal said advertising booklet between said first and second longitudinal halves of the folded jacket sheet member.

9. The method of claim 8 wherein:

said advertising booklet has a page fold axis, and said step of removably securing includes the steps of positioning said page fold axis generally transversely to said first outer edge portion of said jacket sheet member, and bonding said booklet to a side portion of said jacket sheet member with a peel-off adhesive material.

10. A method of fabricating an advertising insert securable within a magazine or other multi-page document, said method comprising the steps of:

providing an elongated rectangular jacket sheet member having first and second longitudinal halves and first and second outer edge portion respectively associated with said first and second longitudinal halves;

providing an advertising booklet or multi-page advertising material having a closed end portion;

providing a folded support sheet having a perforated fold line and an end portion which underlies said closed end portion of said booklet;

adhesively securing said folded support sheet to a side portion of said jacket sheet member;

removably securing said booklet to said folded support sheet by at least one staple member extending through said perforated fold line into said closed end portion of said booklet or multi-page advertising material.

11. The method of claim 10 wherein said advertising booklet has a page fold axis, and said step of removably securing includes the step of positioning said page fold axis generally transversely to said outer end edge portion of said jacket sheet member.

12. Insert apparatus securable page-like within a magazine or other bound multi-page document having a series of pages centrally interconnected generally along a fold axis of the magazine, said insert apparatus comprising:

a jacket structure including:

a flexible jacket sheet member centrally folded along a fold line to bring opposite free edge portions of the folded jacket sheet member together, means for intersecuring said opposite free edge portions, whereby the folded jacket sheet member has first and second facing side portions, a pair of opposite closed side edge portions extending along said fold line in the intersecured free edge portions of the folded jacket sheet member, and a pair of open side edge portions extending between said fold line and the intersecured free edge portions of the folded jacket sheet member, and a booklet or multi-page advertising material concealed and removably secured within the interior of the folded jacket sheet member, said booklet, in its closed orientation, having an elongated configuration and extending lengthwise from adjacent one of said pair of opposite open side edge portions to adjacent the other of said pair of opposite open side edge portions, said booklet having a page fold axis extending transversely to its length and transversely to said fold line, said booklet or multi-page advertising material being removable from within the folded jacket sheet member, said booklet or multi-page advertising material having a closed end portion received within a folded support sheet having a perforated fold line and an end portion which underlies said closed end portion of said booklet or multipage advertising material and is adhesively secured to a side portion of said folded jacket sheet member, said booklet or multipage advertising material being removably secured to said folded support sheet by at least one staple member extending through said perforated fold line into said closed end portion of said booklet or multipage advertising material.

13. The insert apparatus of claim 12 wherein:

said booklet or multi-page advertising material removably bonded to a side portion of said folded jacket sheet member with a peel-off adhesive material.

* * * * *